US007581527B2

(12) United States Patent
Bianchi

(10) Patent No.: US 7,581,527 B2
(45) Date of Patent: Sep. 1, 2009

(54) INTERNAL COMBUSTION ENGINE PROVIDED WITH A VALVE OPENING VARIATION SYSTEM AND VEHICLE EQUIPPED WITH SUCH ENGINE

(75) Inventor: Pietro Bianchi, Turin (IT)

(73) Assignee: Iveco S.p.A., Turin (IT)

( * ) Notice: Subject to any disclaimer, the term of this patent is extended or adjusted under 35 U.S.C. 154(b) by 5 days.

(21) Appl. No.: 11/985,586

(22) Filed: Nov. 16, 2007

(65) Prior Publication Data

US 2008/0149068 A1 Jun. 26, 2008

(30) Foreign Application Priority Data

Nov. 28, 2006 (IT) ..... MI2006A2288

(51) Int. Cl.
*F02D 13/04* (2006.01)

(52) U.S. Cl. ..... 123/321

(58) Field of Classification Search ..... 123/321; 188/273

See application file for complete search history.

(56) References Cited

U.S. PATENT DOCUMENTS

2008/0121477 A1* 5/2008 Bianchi ..... 188/273

FOREIGN PATENT DOCUMENTS

| | | |
|---|---|---|
| EP | 0 543 210 A | 5/1993 |
| EP | 1 347 154 A | 9/2003 |
| GB | 782 351 | 9/1957 |

* cited by examiner

*Primary Examiner*—Hieu T Vo
(74) *Attorney, Agent, or Firm*—Stetina Brunda Garred & Brucker

(57) ABSTRACT

The present invention is relative to an internal combustion engine equipped with a plurality of combustion chambers such to allow the variation of the opening of the valves of said chambers by means of an actuator. The engine according to the invention comprises a cylinder head having a supporting axle (2) on which a plurality of bushings (16, 16') is mounted. Said bushings are made integral one another in rotation around the supporting axle by means of a plate (12) rigidly connected at least in the direction of rotation.

10 Claims, 4 Drawing Sheets

16'

INTERNAL COMBUSTION ENGINE PROVIDED WITH A VALVE OPENING VARIATION SYSTEM AND VEHICLE EQUIPPED WITH SUCH ENGINE

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Field of the Invention

The present invention relates to an internal combustion engine equipped with a plurality of combustion chambers such to allow the variation of the opening of the valves of said chambers by means of an actuator, specifically an internal combustion engine adapted for decompression braking.

2. Prior Art

Decompression braking systems in internal combustion engines are known, specifically in reciprocating engines such as the diesel engines used for heavy haulage. In these engines, decompression braking allows to reach very high specific braking powers, especially in concomitance with supercharging actuated by variable geometry turbo chargers.

It is known that such systems contemplate, during braking, a supplementary opening of the cylinder exhaust valve, to avoid the expansion of air in the cylinder after the compression stroke, which would reduce the braking efficacy.

Various types of devices are used to make such systems, including devices varying the fulcrum of a lever, which may be a rocker arm or a tappet, to allow it to be activated by parts of the camshaft cam profile normally not active due to the presence of higher movement clearance caused by such profile parts.

EP 0 543 210 requires the rockers arms to be fitted on eccentric bushings, in turn mounted on a rocker arm axle. A hydraulic actuator when required turns the bushing, thus displacing the rotation centre of the rocker arm.

Other systems contemplate different cams with different selectively activable levers, but these are very complex systems.

For reasons of construction simplicity and cost-effectiveness, it would be desirable to be able to use one single actuator for all cylinders. Furthermore, the positioning of the actuator is critical for the engine construction, and a suitable arrangement, also outside the engine cover would be preferable. This would also make the conditions, e.g. in relation to temperature and vibrations to which the actuator is subjected, less critical. Furthermore, the limitations of the dimensions of the actuator would be less stringent, with a suitable choice of location. This all would either make possible or facilitate the use of several types of actuators, for example pneumatic actuators.

BRIEF SUMMARY

The problems identified above have been solved according to the present invention by an endothermic engine comprising:

a plurality of combustion chambers each provided with at least one valve and one lever adapted to cause the opening of said valve;

a camshaft with a plurality of cams adapted to control said levers;

a cylinder head having a supporting axle on which a number of bushings, each of which rotationally supports one of said levers, is rotationally and eccentrically mounted;

an actuator adapted to cause the rotation of said bushings by a predetermined angle;

characterised in that said bushings are made integral one another in rotation around said supporting axle by means of a plate rigidly connected to them at least in the direction of rotation.

The rotation of said bushings is such to displace the rotation axis of said levers varying the clearance in the cam lever valve chain, so as to either make active or to deactivate a portion of the cam, in relation to the opening of the valve.

According to an embodiment of the invention, the valves are exhaust valves and said cam portion is adapted to cause a supplementary opening of the valve useful for decompression braking.

The actuator may be suitably connected either to said plate or to one of said bushings.

According to a preferred embodiment, said plate has the shape of a cylindrical surface sector, having a symmetry axis coinciding with the rotation axis of the bushings. According to a particular embodiment, it comprises a series of overlapping sheets having the shape of a cylindrical surface sector, having a symmetry axis coinciding with the rotation axis of the bushings, which is preferably the symmetry axis of the supporting axle. A lever may also control more than one valve, e.g. if the engine has four valves per cylinder and therefore two exhaust valves.

The object of the invention is specifically contained in the accompanying claims.

BRIEF DESCRIPTION OF THE DRAWINGS

The present invention will now be illustrated by means of the detailed description of preferred, but not exclusive, embodiments provided by way of example only, with the aid of the accompanying figures in which.

DETAILED DESCRIPTION

Figure 1:
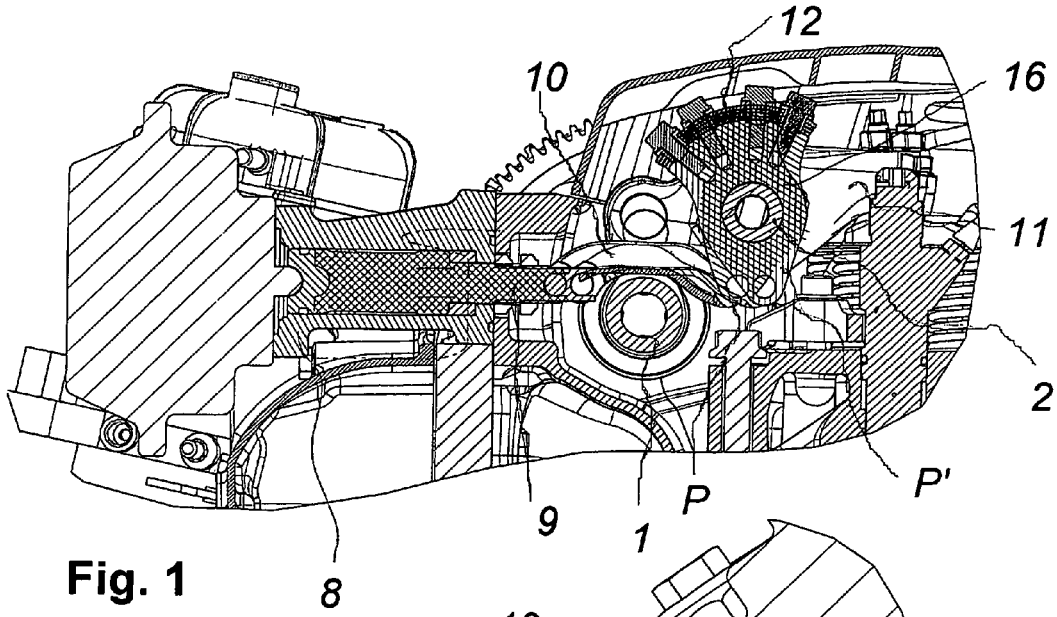
FIG. 1 schematically shows a section according to a plane perpendicular to the supporting axle of a part of an engine head according to the present invention; the two positions of the actuator and consequently of the bushings are overlaid.
Figure 2:
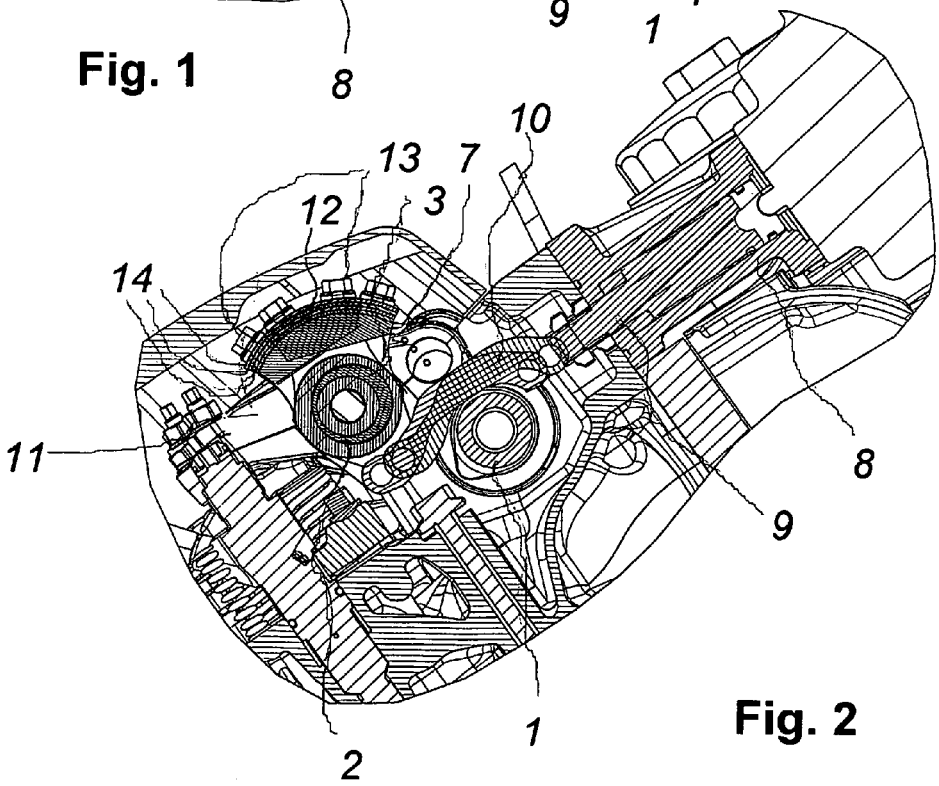
FIG. 2 schematically shows the section in FIG. 1 viewed from the opposite side.
Figure 3:
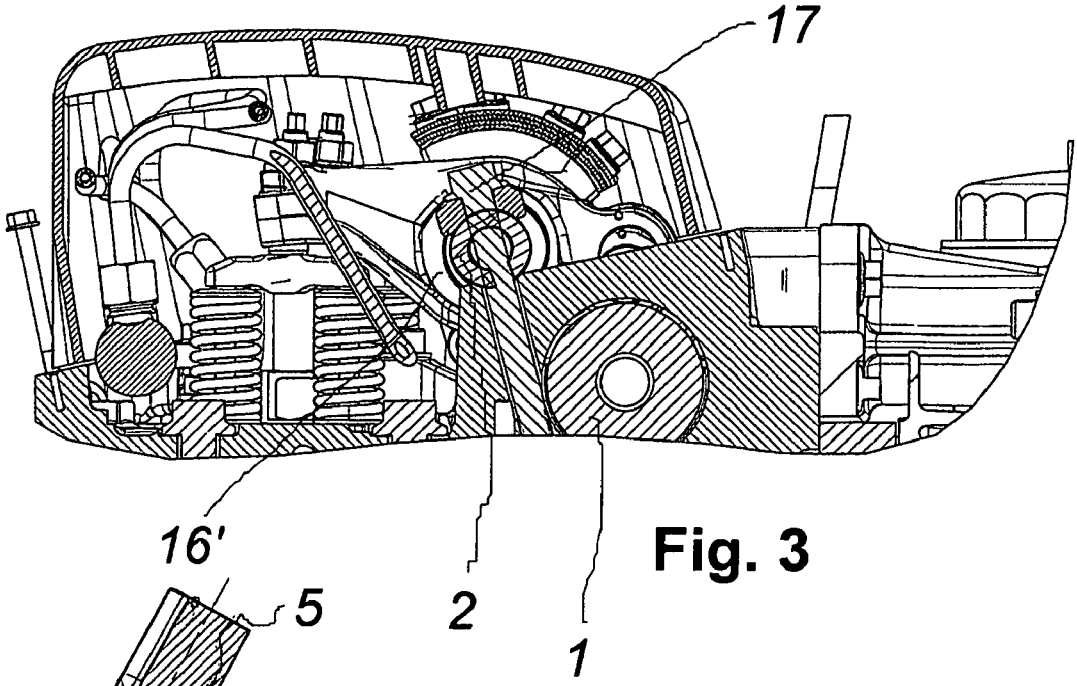
FIG. 3 shows another view of the engine head in section taken along a plane parallel to that of FIG. 1, at an anchoring point of the supporting axle.
Figure 4:
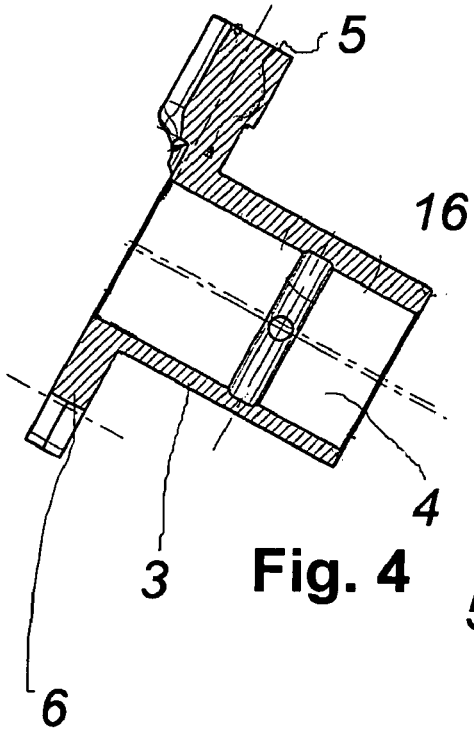
FIGS. 4 and 5 show a supporting eccentric bushing of the levers, in front view in FIG. 5 and in section view taken along plane IV of FIG. 5 in FIG. 4.
Figure 5:
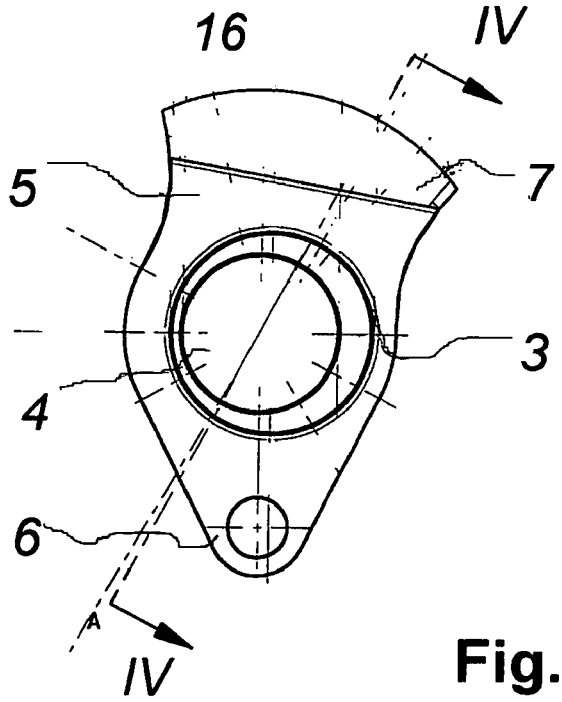

Referring to FIGS. 1 and 2, it is shown a cylinder head of a diesel engine having a plurality of cylinders arranged in line, e.g. six. Each cylinder is provided with suction and exhaust valves, on which levers, in this case rocker arms controlled by the cams suitably arranged on a camshaft 1, act. The levers which control the exhaust valves are rotationally supported by eccentric bushings, in turn rotationally supported on a supporting axle 2. A rotation by a suitable angle of the bushing allows the displacement of the rotation axis of the lever, with variation of clearance, allowing to activate or deactivate cam portions related to the extra opening of the exhaust valves needed for decompression braking, in a way insofar similar to that taught in EP 0 543 210. The engine according to the present invention differs as regards the bushing rotation control system. FIGS. 4 and 5 show a main bushing 16, provided with a cylindrical part 3, intended to be introduced into a hole of one of said levers to rotationally support it, and having eccentric hole 4 for rotationally accommodating the supporting axle. The supporting axle may be anchored in the known manner to cylinder head, for example by means of through screws (reference 17 in FIG. 3). One end of the bushing displays a motion transmission structure 5. There are shown foot 6 of the latter adapted to be suitably connected to the actuator, as shown below, and ridge 7 adapted to be connected to a plate connected to the other supporting bushings of the levers by means of a plate so as to transmit the rotation imparted by the actuator. With reference again to FIGS. 1 and 2, it is observed how actuator 8, which may be a common membrane pneumatic actuator, displays piston 9, on whose end is adapted to be connected, e.g. by means of connecting rod 10 to foot 6 of the main bushing. By operating the actuator the protrusion of piston 9 is provoked, so as to cause the rotation of the bushing from position P to P', in virtue of which, given the eccentricity of cylindrical part 3, the displacement of lever 11 is achieved in the desired manner. The shape of connecting rod 10, in the case in example, allows to arrange the actuator in the position shown, without interfering with camshaft 1.

Figure 6:
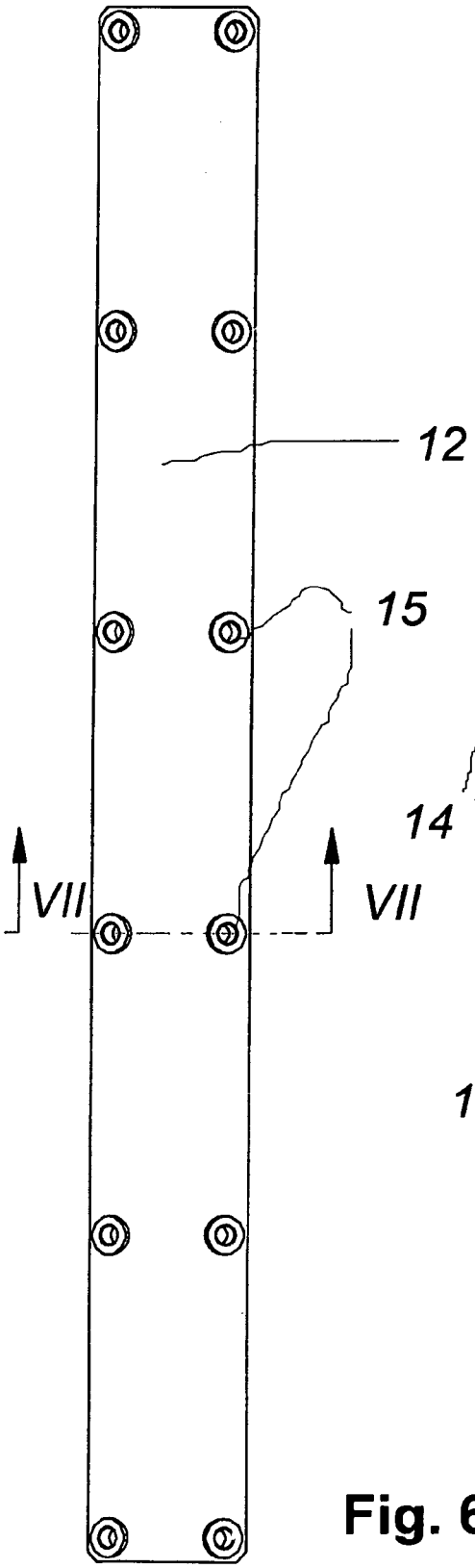
FIGS. 6, 7, 8 respectively show a plan view, a cross section view taken along plane VII in FIG. 6 and a view of the detail enclosed in circle A in FIG. 7, of a connection plate of the eccentric bushings.
Figure 7:
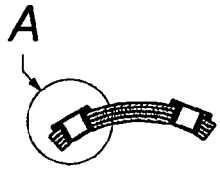
Figure 8:
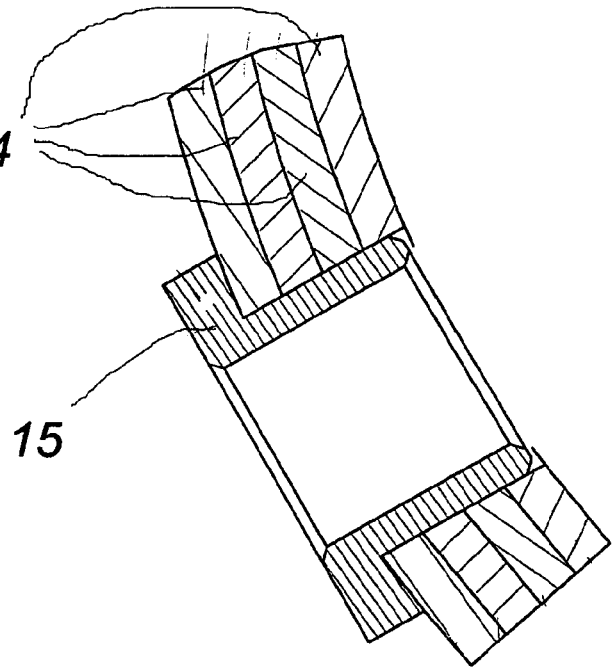

The bushings corresponding to the levers of the other cylinders are mounted similarly on supporting axle 2. Plate 12, of cylindrical shape coaxial to supporting axle 2, is connected to ridge 7 of the bushing, e.g. by means of bolts 13. The other bushings will have a shape similar to that of the described main bushing and may at the most be preferably free from the actuator connection foot and will be connected to plate 12 in a similar manner to the main bushing. Thus, the rotation of all bushings will occur at the same time, obtaining the decompression braking on all cylinders. Plate 12 extends parallely to the supporting axle and to the camshaft. According to a preferred embodiment, it comprises a set of overlapping sheets 14, again having the shape of a cylindrical sector and being coaxial. They are fixed by means of bolts 13 and by means of a fastening bushing 15 (see FIG. 8 which is arranged between sheets 14 and the bolt to prevent direct action) the sheets may be of the suitable number and thickness. In the example shown, four 2-mm thick sheets were used. For example, the thickness may vary from 0.5 to 3 mm, according to needs. The shape of plate 12 allows a good stiffness in the direction of rotation of the bushings, ensuring the precision of movement, with minimum flexural stiffness. This prevents, as a consequence of minor dimensioning imperfections, generation of mechanical tensions, which may cause friction between the bushings and the axle compromising the movement thereof. Dimensions and curvature of the various sheets shall be suitable to allow reciprocal overlapping. FIGS. 6, 7, 8 schematically show plate 12. Protection rings 15 are used to accommodate screws 13 fastening the bushings to the various levers.

According to a preferred embodiment, the main bushing connected to the actuator corresponds to a cylinder centrally positioned with respect to the several in-line cylinders, e.g. in the case of an engine with six in-line cylinders, the main bushing corresponds to either the third or the four cylinder; it is apparent that this allows to reduce the deformation effect of the plate in transmitting the rotational movement, ensuring a higher precision. However, if needed, e.g. due to particular dimensional problems, a different positioning of the actuator is always possible. The levers and the bushings may be such to occupy the entire space of the supporting axle between two anchors of the supporting axle to the cylinder head, so as to prevent axial shifting.

Figure 9:
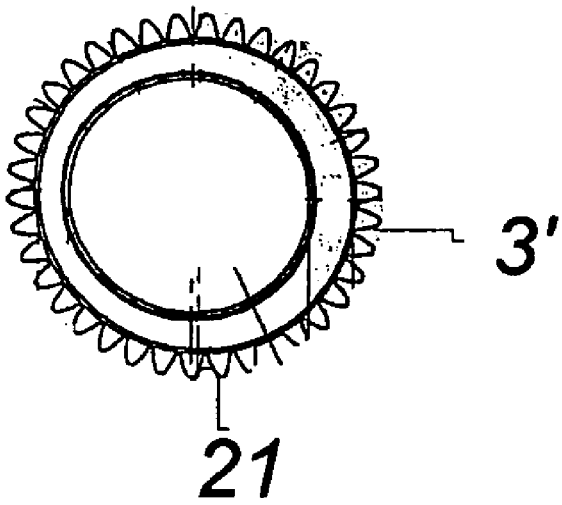
FIG. 9 shows a front view of two constructive components of an eccentric bushing of the levers.
Figure 9:
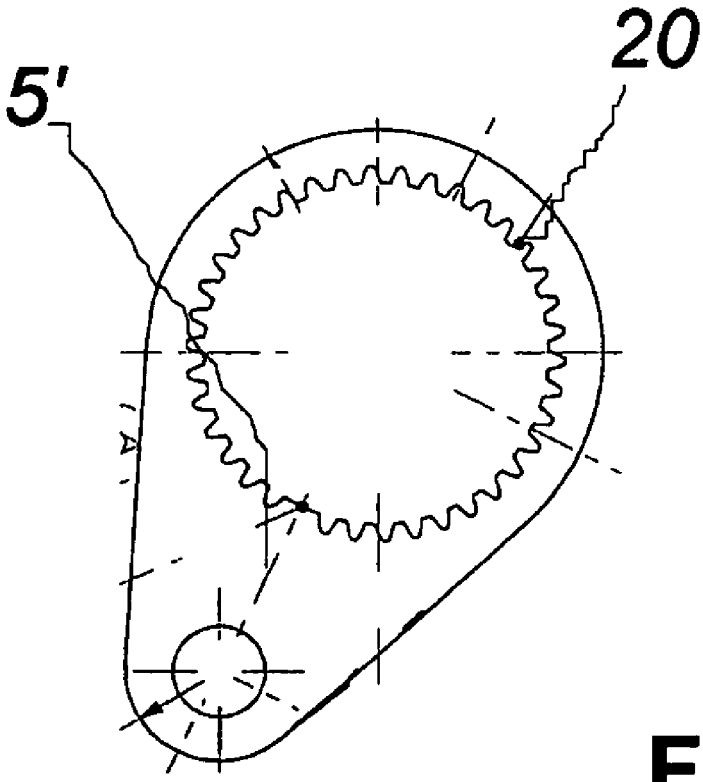

The bushings may be made in a known manner. They may be made of a single part or several parts. For example, FIG. 9 shows two components of a bushing 16', not the main bushing; it is apparent that part 5', to which the plate is connected, displays an internal gearing 20, adapted to be inserted on external gearing 21 of cylindrical part 3'. The main bushing may also be made in a similar manner.

It has been described in detail a case in which the variation of the exhaust valve opening for decompression braking is possible by acting on the corresponding levers, while the opening of the suction valves is fixed. The suction valve control levers may be rotationally supported directly by the supporting axle. In such case, the invention is advantageously applied to a supercharged engine. With suitable changes, it is possible to use the above teachings to vary the opening of the suction valves, if required, or to vary that of the exhaust valves in applications other than decompression braking.

The advantages of the present invention include the possibility of varying the opening of the valves of all cylinders with a single actuator, which may be arranged also outside the cylinder head cover of the engine, for example on it.

The invention also relates to a vehicle provided with engine as described above.

What is claimed is:

1. An endothermic engine, comprising:

a plurality of combustion chambers each provided with at least one valve and a lever (11) adapted to cause the opening of said valve;

a camshaft (1) with a plurality of cams adapted to control said levers;

a cylinder head having a supporting axle (2) on which a plurality of bushings (16, 16'), each of which rotationally supports one of said levers, is rotationally and eccentrically mounted;

an actuator (8) adapted to cause the rotation of said bushings by a predetermined angle;

wherein said bushings are made integral one another in rotation around said supporting axle by means of a plate (12) rigidly connected at least in the direction of rotation.

2. An engine according to claim 1, wherein the rotation of said bushings is such to displace the rotation axis of the levers, varying the clearance in the cam-lever-valve chain, so as to activate or deactivate a portion of the cam, with respect to the opening of the valve.

3. An engine according to claim 2, wherein said valves are exhaust valves and said cam portion is adapted to cause a supplementary opening of the valve useful for decompression braking.

4. A supercharged engine according to claim 1.

5. An engine according to claim 1, wherein several combustion chambers are in line and the actuator is connected to one of said bushings, named main bushing (16), corresponding to a combustion chamber in a central position in said line.

6. An engine according to claim 1, wherein the plate has the shape of a cylindrical surface sector, having a symmetry axis coinciding with the rotation axis of the bushings, which is preferably the centreline of the supporting axle.

7. An engine according to claim 1, wherein said plate comprises a series of overlapping foils (14) having the shape of a cylindrical surface sector.

8. An engine according to claim 1, wherein the actuator is positioned outside a cover which closes the engine cylinder head.

9. An engine according to claim 1, wherein the actuator is of a pneumatic type.

10. A vehicle provided with an engine according to claim 1.

* * * * *